United States Patent [19]

Williamitis

[11] 4,018,061

[45] Apr. 19, 1977

[54] MOISTURE INDICATOR

[75] Inventor: Victor A. Williamitis, Kettering, Ohio

[73] Assignee: General Motors Corporation, Detroit, Mich.

[22] Filed: May 24, 1976

[21] Appl. No.: 689,372

Related U.S. Application Data

[63] Continuation-in-part of Ser. No. 527,610, Nov. 27, 1974, abandoned.

[52] U.S. Cl. ..... 62/125

[51] Int. Cl.[2] ..... F25B 49/00

[58] Field of Search ..... 62/125, 126, 127

[56] References Cited

UNITED STATES PATENTS

| | | | |
|---|---|---|---|
| 3,100,691 | 8/1963 | Jones | 62/125 X |
| 3,533,277 | 10/1970 | Krause | 73/335 X |

*Primary Examiner*—John J. Camby
*Attorney, Agent, or Firm*—K. H. MacLean, Jr.

[57] ABSTRACT

A moisture indicator particularly adapted for use in a refrigerant system to indicate by visual inspection the moisture content of refrigerant therein. A preferred embodiment of the indicator comprises a hygroscopic plastic sleeve which is mounted behind a sight glass within a housing such as a receiver. The whole sleeve can be impregnated with a cobalt salt whose color changes when exposed to water. In use, the color of the indicator may be visually compared with a reference color stripe which does not change color with the addition of moisture and which is preferably applied adjacent the cobalt salt. The sleeve can also be non-hygroscopic plastic, or even metal, coated with a thin film of hygroscopic plastic containing cobalt salts.

3 Claims, 3 Drawing Figures

MOISTURE INDICATOR

This is a continuation-in-part of Ser. No. 527,610 filed Nov. 27, 1974, now abandoned.

This invention relates to moisture indicators and particularly to an indicator to be used in a closed refrigerant system to show the level of moisture within the system.

It is known to utilize salts to sense moisture conditions in liquid and gas streams. The subject moisture indicator utilizes cobalt salts in a particularly well adapted manner to detect moisture in a refrigeration system. Specifically, a sleeve of hygroscopic plastic having a cobalt salt impregnated therein is utilized to form a simple, effective and economical moisture indicator. The aforedescribed cobalt salt impregnated sleeve of hygroscopic plastic provides a moisture indicator responsive to predetermined moisture levels. When a more sensitive and faster responding indicator is desirable, a plastic base which is characterized by lesser hygroscopic properties or even a metal base is used. The indicator is prepared by coating the base with a paint formed by a liquified hygroscopic plastic, a solvent therefor and the cobalt salt. This causes the cobalt salt to be entrained within the plastic coating. The use in a refrigeration system of the subject moisture indicator is advantageous since moisture can be harmful because it may cause corrosion of valve and control members and thereby create a malfunction. Although most refrigerant systems include a desiccant to absorb moisture from the refrigerant, there may still be excess moisture in the system because moisture may be present in quantities greater than the desiccant can effectively absorb. In any event, it is always desirable to be able to visually determine the quality of refrigerant and detect free moisture therein before damage to refrigerant components results.

In one embodiment, the subject moisture indicator consists of a cylinder of water-absorptive or hygroscipic plastic such as cellulose acetate, cellulose acetate butyrate or a nylon, such as Nylon 408. A cobalt salt is applied to the surface of the cylinder to provide a portion of the cylinder characterized by a specific color in the absence of moisture and color change in the presence of moisture. Examples of cobalt salts which can be utilized are cobaltous chloride and cobaltous bromide. Various hygroscopic modifiers may also be added to enhance the moisture-grabbing properties of the hygroscopic plastic. Two of these hygroscopic modifiers are zinc chloride and calcium chloride. The quantity of hygroscopic modifiers hygroscopic may be varied to effect the moisture range to which the indicator is sensitive.

The change in color of a cobalt salt when moisture is introduced is distinctive. For example, the color of cobaltous chloride is normally bluish when in a dry state but the color rapidly changes to a pinkish hue as moisture is absorbed by the hygroscopic plastic base. Likewise, the dry color of cobaltous bromide is greenish and the color changes to a yellowish hue as moisture is introduced. To obtain a desired initial or dry color, the aforementioned salts may be mixed.

For a fast responding and more sensitive moisture indicator, the base is of plastic or metal which exhibits less hygroscopic properties. The cobalt salts are impregnated in a surface layer of hygroscopic plastic material. Particularly on the metal base, it is often desirable to provide a rough surface for adhesion. In any event, as explained in more detail hereinafter, the cobalt salt is evenly distributed and impregnated in a tough plastic coat to provide a predictable response to moisture and to prevent washout by fluid flow.

A preferred method of applying cobalt salt on the base plastic sleeve is to utilize a "paint" made up of a solution of hygroscopic plastic and a solvent to which is added small quantities of finely powdered or dissolved cobalt salt in combination with any hygroscopic modifiers which may be desired. The use of the same plastic for the cylinder and for the paint base provides maximum adhesion between the paint and the base plastic. For example, if cellulose acetate is used for the base plastic of the sleeve, then an acetone solution containing dissolved cellulose acetate is desirably used to carry the cobalt salt indicator. However, quicker sensitivity and longer life are obtained if the hygroscopic plastic film and cobalt salt are applied over lesser hygroscopic plastics or even metal. Adhesion can then be obtained by surface roughness. Any convenient method of applying the mixture is fine. Spraying the paint on the outer surface of the plastic sleeve would normally be most convenient.

When moisture in a refrigeration system is absorbed by the hygroscopic plastic, the cobalt salt therein is affected and its color changes. Within the range established by the quantity of hygroscopic modifiers utilized, the color changes occur gradually, corresponding to the degree of moisture present. By viewing the color surface of the cylinder through a sight glass in the receiver, the degree of moisture in the refrigeration system can be determined most conveniently by comparing the "wet" color with a reference color on the cylinder which does not change with the presence of water.

Therefore, an object of the present invention is to provide a moisture-indicating device comprising a plastic or metal sleeve on which is applied a hygroscopic plastic film containing cobalt salt characterized by a color change produced by the absorption of moisture by the plastic from the environment surrounding the sleeve.

A further object of the present invention is to provide a moisture-indicating device particularly adapted for mounting in a housing of a refrigeration system behind a sight glass and utilizing a water-absorptive plastic material in which a cobalt salt is contained, which indicates increasing moisture levels in the refrigerant by color changes so that an observer looking through the sight glass can readily determine the moisture level.

A still further object of the present invention is to provide a moisture-indicating device consisting of a hygroscopic or non-hygroscopic plastic or metal base on which a cobalt salt paint is applied consisting of dissolved hygroscopic plastic material and a solvent and a quantity of cobalt salt mixed therein.

Further objects and advantages of the present invention will be more readily apparent from the following detailed description, reference being had to the accompanying drawings in which a preferred embodiment is illustrated.

Figure 1:
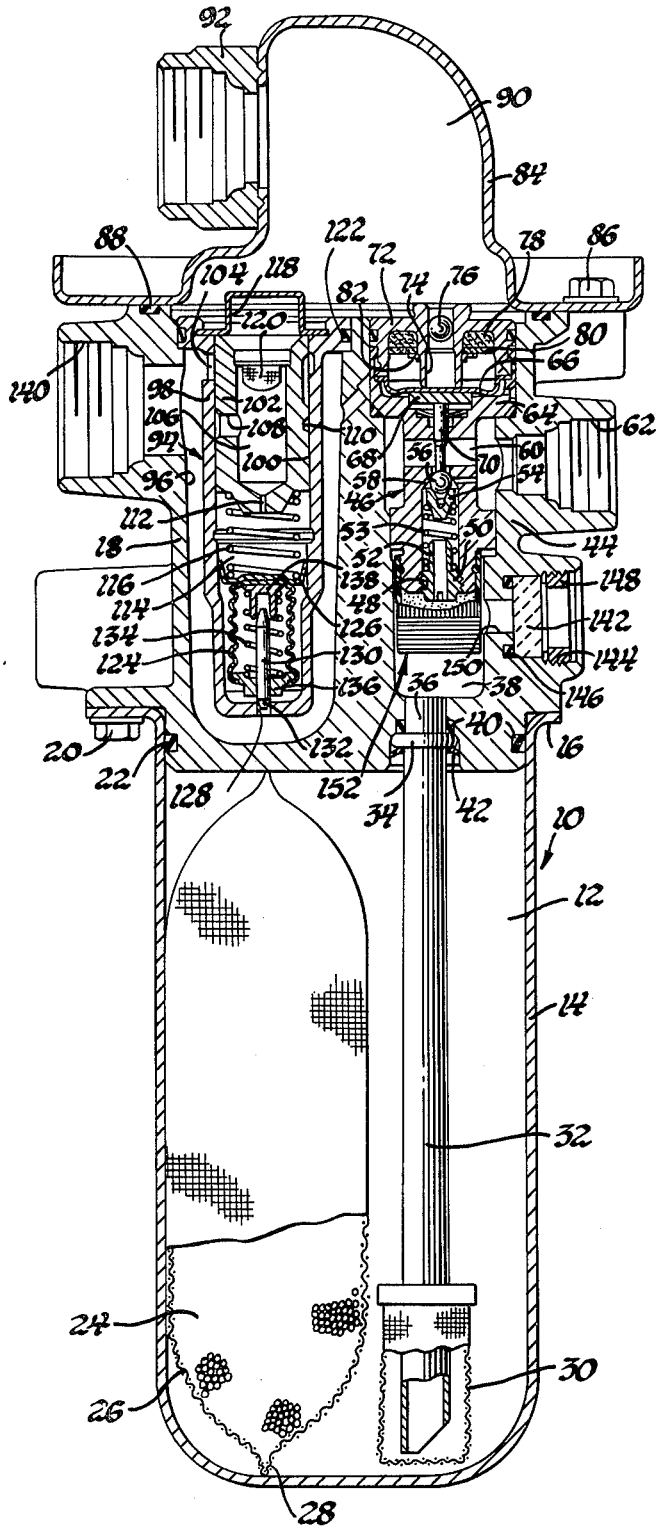
FIG. 1 is a sectional view of an air conditioning receiver including a valve housing.
Figure 2:
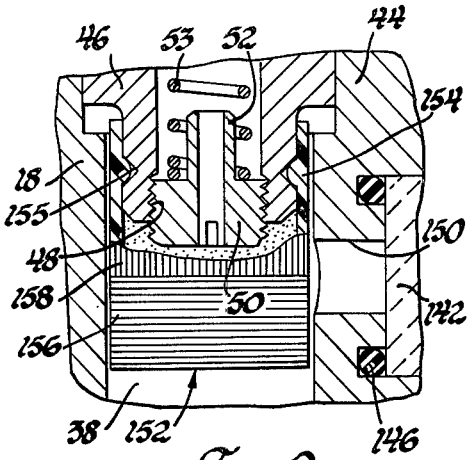
FIG. 2 is an enlarged sectional view of the moisture indicating cylinder shown in FIG. 1.

In FIG. 1 of the drawings, a combination receiver expansion valve and suction throttling valve assembly 10 is illustrated. The assembly 10 provides a unitary structure housing refrigerant valves for an air conditioning system and the connections thereto. In addition, a desiccant is supported within the receiver portion of assembly 10 to absorb moisture. An inlet fitting (not visible in FIG. 1) is adapted for connection to the condenser of an automotive air conditioning system to introduce refrigerant to the receiver 10. The refrigerant flows from the inlet into an interior space 12 which is formed by a cupshaped container member 14. The upper peripheral edge 16 of the container member 14 is attached to a valve housing member 18 by fasteners 20. An O-ring seal 22 between the container member 14 and the valve housing member 18 provides a leak-tight seal therebetween.

Refrigerant within interior space 12 is exposed to a quantity of desiccant material 24 such as silica gel. The material 24 is contained within a polymeric envelope 26 which is formed by heat sealing the polymeric felt at a peripheral edge portion 28. The polymeric felt 26 is fluid-pervious to permit refrigerant and moisture to pass therethrough for separation of the moisture from the refrigerant by the silica gel 24.

Refrigerant within the space 12 is drawn through a strainer assembly 30 supported about the end of a vertical tube 32. The strainer assembly 30 grippingly engages tube 32 and includes a fine wire screen to prevent the passage of foreign particles such as metal chips through the air conditioning system. The tube 32 is supported by housing 18 at its upper end which is provided with an annular shoulder 34 and a projection 36 which extends into the chamber 38 formed within the housing 18. An O-ring seal 40 prevents fluid leakage in bypass relation to the tube 32. The tube and O-ring are secured to the housing 18 by a retainer 42. Chamber 38 is provided with a restricted annular portion 44 which forms a seal with the peripheral surface of a bodily removable thermostatic expansion valve 46. This thermostatic expansion valve 46 has a threaded cavity and a passage 48 containing a perforated threaded adjusting member 50. Member 50 is provided with a lower spring retainer portion 52 to support the bottom of a coil spring 53. The top of the spring 52 is engaged by an upper spring retainer 54 which bears upwardly against a ball valve 56 for normally holding the ball valve against a valve seat 58. Seat 58 is formed by a shoulder in the upper continuation of the threaded cavity and passage 48. A transverse outlet passage 60 provides a direct communication with the outlet 62 in the housing 18. Outlet 62 is adapted to be connected to the conduit which connects the assembly 10 to the evaporator inlet of the air conditioning system.

The thermostatic automatic expansion valve 46 has an enlarged upper portion 64 containing an operating diaphragm 66 with its central portion resting upon an enlarged head 68 of an operating pin 70. The lower end of the operating pin 70 engages ball valve 56 to move it downward and away from seat 58 to permit the flow of refrigerant from the chamber 38 through the expansion valve to passage 60 and through outlet 62 to the evaporator.

The diaphragm 66 of valve 46 is held within the valve's upper portion 64 by an inverted cup-shaped member 72 which has a downwardly extending tubular portion 74 which serves as a stop to limit upward movement of diaphragm 66. The tubular portion 74 is closed by a ball 76 which is sealed to the member 72 by solder. The member 72 defines a space containing a quantity of adsorbent 78 such as activated charcoal which is held in place by a porous member 80. Member 80 is held by a Belleville spring type member 82. The space defined by member 72 forms a temperature-responsive chamber which contains a suitable refrigerant such as R-22 ($CHClF_2$, monochlorodifluoromethane) which is absorbed and evolved from the adsorbent 78 as its temperature falls and rises.

Above the expansion valve 46, the housing 18 supports an end member 84 which is attached thereto by fastener means 86. An O-ring 88 prevents fluid leakage therebetween. The member 84 defines an inlet chamber 90 which is connected by an inlet fitting 92 to the outlet of the evaporator to receive refrigerant therefrom. Refrigerant then flows from chamber 90 through a vertically mounted suction throttling valve 94 which fits into a cavity 96 in housing 18. The suction throttling valve 94 includes a one-piece housing 98 containing an enlarged bore 100 which slidably receives a reciprocal piston valve 102. The piston valve 102 is adapted to cover and uncover the ports 104 in the side walls of the housing 98 for controlling refrigerant flow. The housing 98 has an annular flange at its upper end which rests against a shoulder of the housing 98. An O-ring seal 122 between the two members prevents fluid leakage thereby.

A central recess 106 in valve 102 is connected to side outlets 108 and an annular groove 110 to permit a limited fluid flow through a restrictive passage 112 to a chamber 114. Chamber 114 contains a coil spring 116 beneath the piston valve 102. The spring 116, together with the pressure differential between chamber 114 and above the valve controls the position of the valve 102. Maximum upward movement of the piston valve 102 is limited by a spring retainer 118 which expands into a groove formed in the upper portion of housing 98. The upper end of the recess 106 is covered by a screen 120 which prevents the continued flow of particles in the refrigerant system.

The pressure in the spring chamber 114 is regulated by operation of a sealed bellows 124 which is located beneath the spring 116. The top of the bellows 124 is supported by and bonded to a cup-shaped and perforated bellows support 126 which also serves as a spring retainer for the bottom of spring 116. The housing 98 is provided with a closed wall at the bottom containing an outlet bleed opening 128. A valve 130 is coaxially supported with respect to opening 128 and has a cone-shaped lower portion 132 adapted to extend into the opening 128. The bellows 124 is evacuated and contains an interior spring 134 extending between bottom 136 and an upper spring retainer 138 within the bellows.

The internal spring 134, together with the spring of the bellows itself, determine the pressure in space 114 at which the bellows 124 will axially contract to open the bleed 128. Likewise, the valve 130 is moved by the bellows 124 to close the bleed 128 whenever the pressure within the evaporator falls to a level corresponding to the freezing point of water. The refrigerant freeze pressure corresponds to a temperature at which frosting of the evaporator begins under adverse operating conditions. A desirable setting is normally about 29 to 30 pounds per square inch gauge or 43.7 to 44.7 pounds per square inch absolute. By controlling the pressure in space 114, the valve 102 regulates refrigerant flow from the evaporator to maintain evaporator pressure above the freezing level. For more details of the combination receiver, expansion valve and throttling valve reference is made to U.S. Pat. No. 3,525,234 to Widdowson which issued Aug. 25, 1970 and is assigned to the General Motors Corporation.

Figure 3:
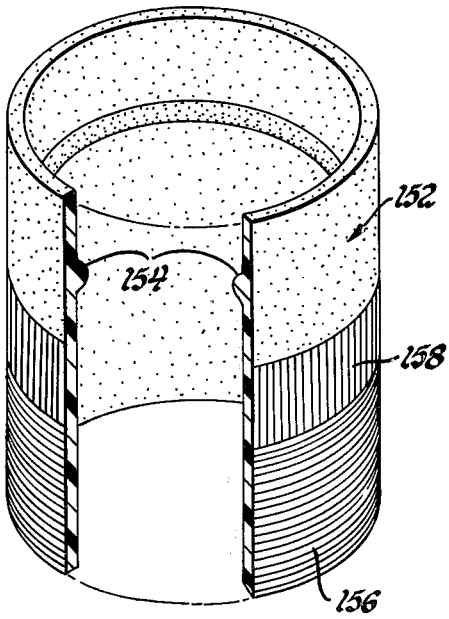
FIG. 3 is a perspective view of the moisture-indicating cylinder partially broken away.

As previously discussed, it is desirable to provide a moisture indicator to determine the moisture level in the refrigerant. To this end, the housing 18 contains a sight glass 142 supported within a threaded bore 144. The sight glass 142 is held against an O-ring type seal 146 for sealing by a threaded retainer 148. A passage 150 in housing 18 permits an external examination of a cylindrical moisture indicator 152. The moisture indicator 152 has an inwardly extending ridge or projection 154 which is best shown in FIG. 3 and which coacts with a groove 155 formed in the lower portion of the housing 46.

The cylindrical moisture indicator 152 is molded of a hygroscopic plastic material, such as cellulose acetate, cellulose acetate butyrate or nylon containing a cobalt salt. These materials readily absorb moisture from refrigerant. The aforementioned may be modified by certain compounds, such as zinc chloride or calcium chloride which may be referred to as hygroscopic modifiers. They increase the moisture-absorbing properties of the base plastic so that differing ranges of sensitivity can be achieved by varying the quantity of modifier.

In the present invention, the cylindrical sleeve 152 has a coating of moisture-absorbing "paint" applied to its outer surface. This paint has a hygroscopic base which may be similar or different from the plastic material from which the sleeve is formed. The coating plastic is dissolved in a suitable solvent. A quantity of moisture-indicating cobaltous salt, such as cobaltous chloride or cobaltous bromide is then mixed with the coating plastic and solvent. The resultant fluid is sprayed or otherwise applied to the outer surface of the indicator, as shown by the numeral 156. The dry color of the lower portion 156 of the indicator 152 indicates no moisture has been absorbed. When moisture is absorbed the cobaltous salt changes in color so that an observer looking through the sight glass 142 can visually determine the moisture level of refrigerant within the system. The portion 158 of the indicating cylinder 152 may have a non-changing color applied as a reference for comparison or contrast with the lower portion 156. The portion 158 may either resemble the dry color or the wet color of the cobaltous salt utilized to aid the observer in determining the moisture level of the refrigerant system. The following table shows the expected color change with moisture absorption of cobaltous salts:

| | Dry | Wet |
|---|---|---|
| Cobaltous Chloride | Bluish | Pinkish |
| Cobaltous Bromide | Greenish | Yellowish |

The moisture-indicating device described above and shown in the drawings is a preferred embodiment. It is obvious that a person skilled in the art may make modifications which are within the scope of the invention as claimed below.

What is claimed is as follows:

1. A moisture indicator for detecting the relative degree of water mixed with refrigerant in a refrigeration system comprising:

an indicator base made from hygroscopic plastic material mounted within a housing of the refrigerant system in contact with the flow of refrigerant therethrough;

a paint applied to the surface of said indicator base made up of a solution of a hygroscopic plastic and a solvent and with finely divided particles of a cobalt salt therein whereby said paint is characterized by one color when in the absence of significant quantities of water and by a gradual color change to a second color with the presence of increasing quantities of water;

a reference band of colored material on said indicator base adjacent to said painted surface for visual comparison with the color of said painted surface.

2. A refrigerant component including a moisture indicator for detecting the relative degree of water mixed with refrigerant in a refrigeration system comprising:

a housing with a passage for refrigerant flow between an inlet and an outlet;

means in said housing enabling an observer to visually examine said housing passage from outside said housing;

an indicator base within said passage in the sight line of said examining means of said housing;

said base being made of a hygroscopic plastic material;

a portion of said base being treated with a paint made up of a solution of hygroscopic plastic and a solvent and with finely divided particles of a cobalt salt therein whereby said paint is characterized by one color when in the absence of significant quantities of water and by a gradual color change to a second color with the presence of increasing quantities of water;

a reference band of colored material on said base adjacent to said painted surface for visual comparison with the color of said painted surface.

3. A moisture indicator for detecting the relative degree of water mixed with refrigerant in a refrigeration system comprising:

an indicator base of a material which is stable in a refrigerant environment adapted to be mounted within a housing of the refrigerant system in contact with the flow of refrigerant therethrough;

a paint applied to the surface of said indicator base made up of a solution of a hygroscopic plastic and a solvent and with finely divided particles of a cobalt salt therein whereby said paint is characterized by one color when in the absence of significant quantities of water and by a gradual color change to a second color with the presence of increasing quantities of water;

whereby said paint provides an erosion resistant coating resistant to fluid wear in which the fine particles of cobalt salt are dispersed and held in a substantially uniform distribution.

* * * * *